US006638103B2

(12) United States Patent
Pasternak

(10) Patent No.: US 6,638,103 B2
(45) Date of Patent: Oct. 28, 2003

(54) MOUNTING FIXTURE FOR ELECTRICAL LIGHT FIXTURE OR FAN

(75) Inventor: Barton A. Pasternak, Elkins Park, PA (US)

(73) Assignee: Angelo Fan Brace Licensing LLC, Philadelphia, PA (US)

( * ) Notice: Subject to any disclaimer, the term of this patent is extended or adjusted under 35 U.S.C. 154(b) by 0 days.

(21) Appl. No.: 10/106,061

(22) Filed: Mar. 27, 2002

(65) Prior Publication Data

US 2002/0142641 A1 Oct. 3, 2002

Related U.S. Application Data

(60) Provisional application No. 60/278,863, filed on Mar. 27, 2001.

(51) Int. Cl.[7] ..... H01R 13/66

(52) U.S. Cl. ..... 439/537; 439/700

(58) Field of Search ..... 439/289, 700, 439/824, 611, 537; 313/49, 50, 51

(56) References Cited

U.S. PATENT DOCUMENTS

| | | | | | |
|---|---|---|---|---|---|
| 2,300,487 | A | * | 11/1942 | Conteville | 439/345 |
| 3,638,170 | A | * | 1/1972 | Clement et al. | 439/537 |
| 4,029,375 | A | * | 6/1977 | Gabrielian | 439/66 |
| 4,904,213 | A | * | 2/1990 | Hock et al. | 439/824 |

* cited by examiner

*Primary Examiner*—Renee Luebke
*Assistant Examiner*—Ann McCamey
(74) *Attorney, Agent, or Firm*—Drinker Biddle & Reath LLP

(57) ABSTRACT

A mounting fixture for electrical light fixture or fan comprising an assembly having an electrical box, a conducting plate, a neutral plate and a mounting plate such that the contact points on the conducting plate make contact with the contact members on the mounting plate by a spring-loading action.

6 Claims, 3 Drawing Sheets

MOUNTING FIXTURE FOR ELECTRICAL LIGHT FIXTURE OR FAN

CROSS REFERENCE TO RELATED APPLICATION

This application claims the benefit of U.S. Provisional Application No. 60/278,863 filed Mar. 27, 2001.

FIELD OF THE INVENTION

The invention relates to electrical fixtures, specifically, the invention is directed to a mounting fixture for electrical light fixture or fan.

SUMMARY OF THE INVENTION

A mounting fixture having features of the present invention comprises an electrical box located in a wall or ceiling having electrical power leads. The electrical leads normally comprise two A/C wires and one ground wire. The A/C wires and ground wire are threaded through the electrical box and contact a conducting plate. The conducting plate has electrical contact points thereon. A neutral or non-conducting plate is placed over the conducting plate. The neutral plate has at least one opening therein for receiving the electrical contact points.

An electrical light fixture or electrical fan is provided with a mounting plate, having electrical mounting contacts. The electrical mounting contacts extend through the openings in the neutral plate, and contact the conducting plate to provide power to the fixture or fan.

BRIEF DESCRIPTION OF THE DRAWINGS

For the purpose of illustrating the invention, the drawings show a form of the invention which is presently preferred. However, it should be understood that this invention is not limited to the precise arrangements and instrumentalities shown in the drawings.

DETAILED DESCRIPTION OF DRAWINGS

Figure 1:
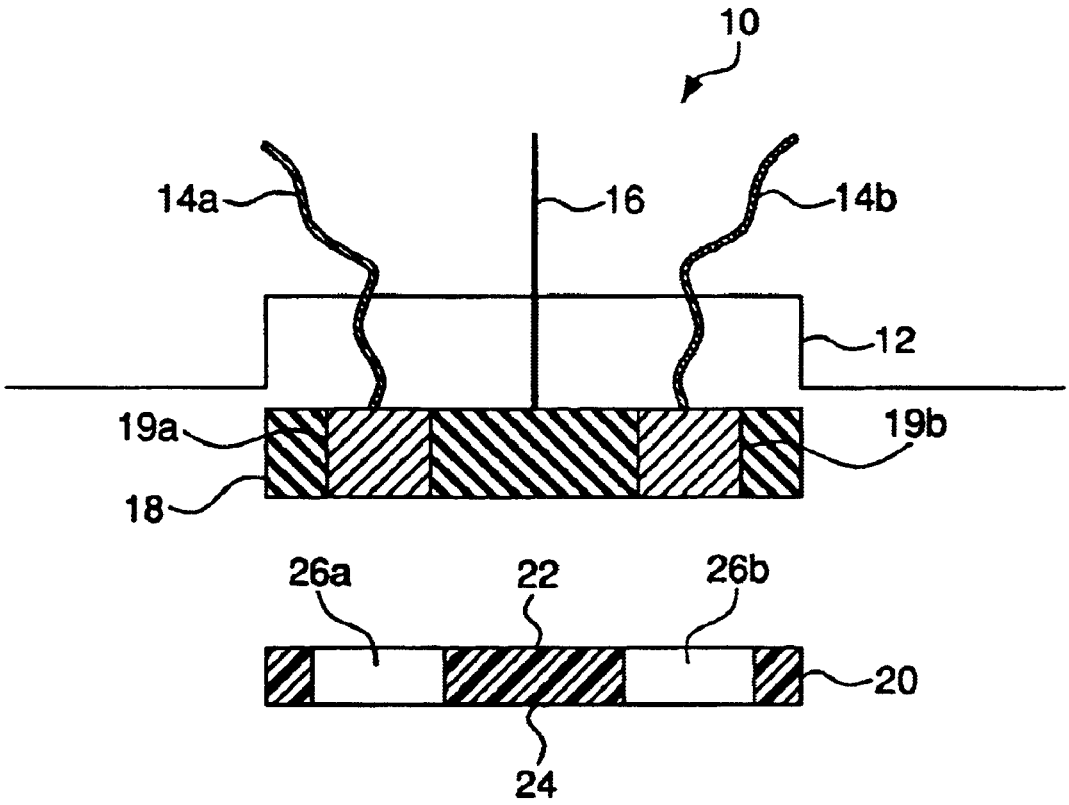
FIG. 1 is a partial assembly of the conducting plate and neutral plate of one embodiment of the present invention.
Figure 2:
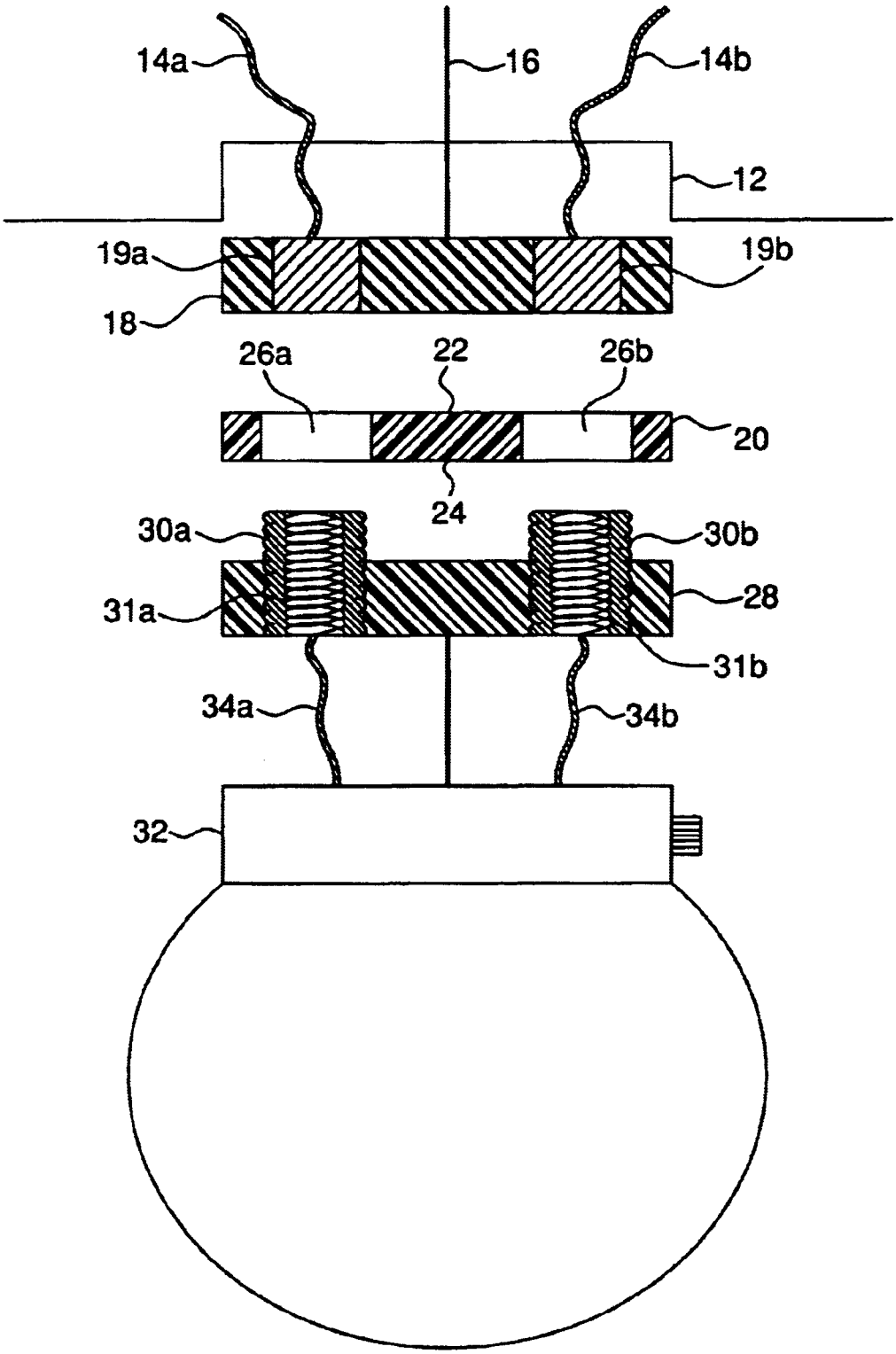
FIG. 2 is an assembly diagram of one embodiment of the present invention.

In the drawings, wherein like numerals identify like elements, there is shown in FIGS. 1 and 2 a mounting fixture 10. The mounting fixture 10 comprises an electrical box 12 found in walls and ceilings, as is known in the art. The electrical box 12 has two A/C electrical wires 14(*a*) and 14(*b*) which supply A/C electrical current, and one ground wire 16.

The electrical wires 14(*a*) and 14(*b*) are connected to conducting areas 19(*a*) and 19(*b*) formed in the conducting plate 18 at spaced intervals. The conducting areas 19(*a*) and 19(*b*) conduct electricity. Thus, when live electrical wires 14(*a*) and 14(*b*) are connected to the conducting areas 19(*a*) and 19(*b*), the conducting areas 19(*a*) and 19(*b*) are "live" or "hot." It is appreciated that the conducting areas 19(*a*) and 19(*b*) may be formed of any appropriate material for conducting an electrical current, while the remainder of the conducting plate 18 is formed from a non-conducting or insulating material. It is also appreciated that the conducting plate 18 may be formed in any appropriate shape or size.

A neutral plate 20 is provided formed from a non-conducting or insulating material. The neutral plate 20 has a first surface 22 and a second surface 24, and channels 26(*a*) and 26(*b*) extending therethrough from the first surface 22 to the second surface 24. The first surface 22 is located adjacent the conducting plate 18 when assembled.

A mounting plate 28 is provided adjacent the second surface 24 of the neutral plate 20. The mounting plate 28 has contact members 30(*a*) and 30(*b*) formed thereon adapted to be inserted through the channels 26(*a*) and 26(*b*) of the neutral plate 20 and contact the conducting areas 19(*a*) and 19(*b*). The contact members 30(*a*) and 30(*b*) are formed from a material which is an electrical conductor.

In one embodiment of the present invention, it is contemplated that the contact members 30(*a*) and 30(*b*) are spring 31 loaded, so as to maintain the contact members 30(*a*) and 30(*b*) in positive contact with the conducting areas 19(*a*) and 19(*b*).

As shown in FIG. 2, a lighting fixture 32 is wired to the contact members 30 of the mounting plate 28. Electrical current from the conducting plate 18 is carried by the contact members 30 to the wires 34(*a*) and 34(*b*), thus supplying electrical current to the lighting fixture 32. It is appreciated that the mounting fixture of the present invention could be used with any electrical appliance, for example, an electrical ceiling fan.

Figure 3:
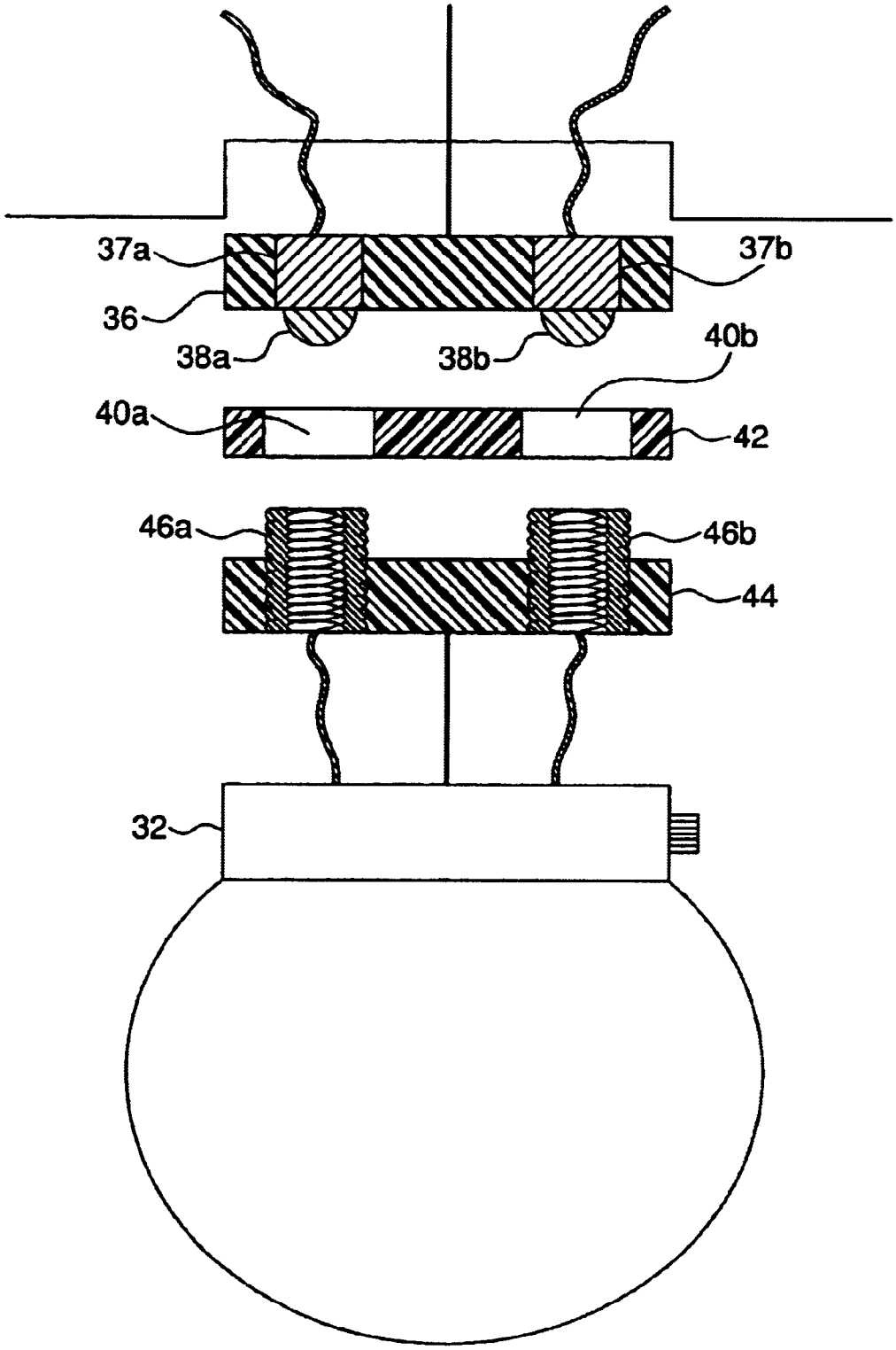
FIG. 3 is an assembly diagram of an alternate embodiment of the present invention.

In another embodiment of the current invention, as shown in FIG. 3, the conducting plate 36 is provided with conducting areas 37(*a*) and 37(*b*). Conducting members 38(*a*) and 38(*b*) extend from the conducting areas 37(*a*) and 37(*b*). The conducting members 38(*a*) and 38(*b*) are adapted to extend into the channels 40(*a*) and 40(*b*) formed in the neutral plate 42. The mounting plate 44 has contact members 46(*a*) and 46(*b*) which extend into the channels 40(*a*) and 40 (*b*) and compress on contact with the conducting members 38(*a*) and 38(*b*).

The present invention may be embodied in other specific forms departing from the spirit or essential attributes thereof and, accordingly, reference should be made to the appended claims, rather than to the foregoing specification, as indicating the scope of the invention.

What is claimed is:

1. A mounting fixture for electrical light fixture or fan comprising:

an electrical box having a plurality of alternating current wires and a ground wire;

a conducting plate having an upper surface and a lower surface and comprising a plurality of electrically conducting contact points, the upper surface being adjacent to the electrical box, wherein the alternating current wires and the ground wire pass through the electrical box to contact with the contact points at the upper surface of the conducting plate;

a neutral plate having an upper surface and a lower surface and comprising a plurality of channels therethrough, the upper surface of the neutral plate being adjacent to the lower surface of the conducting plate, and wherein the number of channels equals the number of contact points and each channels aligns with each contact point, a mounting plate having an upper surface and a lower surface and comprising a plurality of subassemblies, each subassembly having an electrically conducting contact member paired with an electrically conducting spring, wherein the upper surface of the mounting plate is adjacent to the lower surface of the neutral plate and wherein the paired subassemblies align with the channels so that each spring is coilingly engaged with its paired contact member such that the contact members are caused to protrude through the channels to make contact with the contact points at the lower surface of the conducting plate.

2. The mounting fixture of claim 1, wherein the plurality of alternating current wires equals two.

3. The mounting fixture of claim 1, wherein the plurality of contact points, the plurality of channels, and the plurality of paired contact member-spring subassemblies equal two.

4. A mounting fixture for electrical light fixture or fan comprising:

an electrical box having a plurality of alternating current wires and a ground wire;

a conducting plate having an upper surface and a lower surface and comprising a plurality of electrically conducting contact points, each contact point having an electrically conducting contact member extending therefrom on the lower surface of the conducting plate, the upper surface being adjacent to the electrical box, wherein the alternating current wires and the ground wire pass through the electrical box to contact with the contact points at the upper surface of the conducting plate;

a neutral plate having an upper surface and a lower surface and comprising a plurality of channels therethrough, the upper surface of the neutral plate being adjacent to the lower surface of the conducting plate, and wherein the number of channels equals the number of contact points and wherein the plurality of conducting members are aligned with and adapted to fit into the channels;

a mounting plate having an upper surface and a lower surface and comprising a plurality of subassemblies, each subassembly having an electrically conducting contact member paired with an electrically conducting spring, wherein the upper surface of the mounting plate is adjacent to the lower surface of the neutral plate and wherein the paired subassemblies align with the channels so that each spring is coilingly engaged with its paired contact member such that the contact members are caused to protrude into the channels and thereby maintain contact with the conducting members.

5. The mounting fixture of claim 4, wherein the plurality of alternating current wires equals two.

6. The mounting fixture of claim 5, wherein the plurality of conducting members, the plurality of channels, and the plurality of paired contact member-spring subassemblies equal two.

* * * * *